United States Patent [19]

deBoer et al.

[11] 4,037,422

[45] July 26, 1977

[54] ARTICULATED JET SLED

[75] Inventors: Nico deBoer, Kenner; Robert L. Olsen, New Orleans, both of La.

[73] Assignee: J. Ray McDermott & Co. Inc., New Orleans, La.

[21] Appl. No.: 610,105

[22] Filed: Sept. 4, 1975

[51] Int. Cl.[2] ..... E02F 5/06

[52] U.S. Cl. ..... 61/72.4

[58] Field of Search ..... 61/72.4; 37/58, 61–67

[56] References Cited

U.S. PATENT DOCUMENTS

| | | | |
|---|---|---|---|
| 3,258,928 | 7/1966 | Broadway et al. | 61/72.3 |
| 3,368,358 | 2/1968 | Elliott | 61/72.4 |
| 3,429,132 | 2/1969 | Martin | 61/72.4 |
| 3,786,642 | 1/1974 | Good et al. | 61/72.4 |
| 3,978,679 | 9/1976 | Lelomte | 61/72.4 |

*Primary Examiner*—Jacob Shapiro

*Attorney, Agent, or Firm*—Arnold, White & Durkee

[57] ABSTRACT

An apparatus for entrenching submerged elongate structures, such as a pipeline, within the bed of a body of water. A spreader frame straddles the pipeline to be entrenched. Port and starboard sled frame members having pontoons are pivoted in the spreader frame on each side of the pipeline for pivotal movement. Each sled frame member carries a fluid jetting leg which includes jetting nozzles. Hydraulically operated linkage moves the sled frame members causing the jetting legs to substantially enclose the pipeline bringing the ends of the fluid jetting legs into close proximity beneath the pipeline. Jetting action by the nozzles forms a trench in the bed for receiving the pipeline. The fluid jetting legs are adjustable for various depths and for various sizes of pipeline. The combined structure formed by a sled frame member and fluid jetting leg has a center of gravity that is inboard of its pivot point causing the jetting legs to move apart upon the apparatus being urged off the submerged floor such that the jetting sled does not engage or tangle the pipeline.

24 Claims, 15 Drawing Figures

ARTICULATED JET SLED

BACKGROUND OF THE INVENTION

The present invention relates to an apparatus for entrenching submerged elongate structures and, more particularly, to an apparatus for entrenching submerged pipelines.

In recent years, there have been many large oil and natural gas deposits discovered in off-shore locations. Subsequent drilling and production of these deposits and the need for an economical means for transporting the oil and gas obtained, from the production site to a collection terminal, has resulted in the need for long distance submerged pipelines.

Initially, pipelines were laid and left to rest upon the ocean floor. It soon became apparent, however, that serious damage was being inflicted upon the pipelines, such as for example, shifting of the pipelines due to currents, corrosion of exposed portions of the pipelines, and general structural damage caused by entanglement with marine equipment. In order to solve the problems encountered, it was found desirable to entrench the submerged pipeline beneath the surface of the ocean floor.

One device that has found some degree of success has been the submerged sled. The sled has a frame structure for straddling the pipeline and includes port and starboard pontoon runners. The system also includes port and starboard high pressure jetting nozzles for dislodging soil from the waterbed and forming a trench for the pipeline. The sled is pulled along the ocean floor by a surface vessel which also supplies the required high pressure fluid for the jetting nozzles.

While the general concept of a jet sled has shown promise, the specific burying sleds thus far developed have suffered from several basic problems.

One problem has been difficulty in forming a trench through regions of hard or tough clay formations within the ocean floor. Under such conditions it is desirable to remove the miniumum volume of material to form the trench of desired depth. Thus, a jet sled having vertically disposed jet legs designed to form a trench having a rectangular cross section is inefficient in such cohesive subsoils. One solution to the problem has been to form the jet legs having the jetting nozzles on a curved fashion to fit around and below the pipeline being laid. Details of this type of construction may be had by reference to Perot, U.S. Pat. No. 3,751,927.

While the above described arrangement decreases somewhat the volume of material to be removed to form a trench, a sled using such an arrangement cannot be readily removed or withdrawn from the pipeline under emergency conditions. Divers would be required to go down to the submerged location, partially disassemble the device and manually jet away the subsoil to permit the conduits to be freed from the pipeline. The use of divers is both time consuming, expensive and hazardous.

Further, prior burying sleds, though being adjustable, require extensive efforts to alter the depth of which a trench can be formed and the size of pipeline which can be accomodated. Adjustability of prior burying sleds has been accomplished by horizontal guide tracks which receive sliding mounts attached to the fluid conduits. When the conduits are in position around the pipeline, the structure is pinned by divers. An example of this approach to burying sled adjustability is that of the reference Perot, U.S. Pat. No. 3,751,927.

Prior entrenching devices have relied upon engagement with the pipeline to afford directional guidance. Such devices have used roller mechanisms which wrap around a major portion of the circumference of the pipeline and ride along the pipeline supported by the rollers. One such device is that described in U.S. Pat. No. 3,732,701, issued to Robert P. Lynch. Other devices, while not being supported by the rollers, do rely on pipeline engagement by rollers to guide the device. An entrenching device of this type is that shown in U.S. Pat. No. 3,583,170, issued to DeVries.

From the foregoing, it is apparent that it would be highly desirable to provide an apparatus for entrenching submerged elongate structures which would be capable of forming a trench particularly on cohesive clay-type subsoil with a minimum volume of material being removed and be operable to permit rapid removal off the elongate structure without inflicting damage thereto. Further, it would be desirable to provide an entrenching apparatus which does not ride upon the elongate structure to obtain directional guidance. Moreover, it is additionally desirable to provide a rugged burying sled capable of providing adjustment for various trench depths and various pipeline sizes.

SUMMARY OF THE INVENTION

The instant invention provides a novel apparatus for use in entrenching elongate structures in the bed of a body of water.

It is one feature of this invention to provide an improved jet sled apparatus which is readily removable from a substantially enclosed position about a submerged pipeline without damage to the pipeline.

It is among the other features of this invention to provide a jet sled which does not engage the submerged pipeline to obtain directional guidance.

It is a further feature of this invention to provide a jet sled which minimizes the amount of waterbed to be removed to make a trench for the submerged pipeline.

It is among the further features of this invention to provide a jet sled that is fully and easily adjustable for various pipeline diameters and burying depths.

It is a further feature of this invention to provide a jet sled that is readily put into or taken out of operation without the use of divers to disconnect and set up the apparatus.

It is yet another feature of this invention to provide a jet sled which senses contact with the submerged pipeline to guide the barge and indicate cross-pull being applied to the sled.

These and other features of the instant invention will be apparent from the following specification, drawings and claims.

The articulated jet sled of the instant invention comprises a spreader frame member for straddling the submerged pipeline and a port and a starboard jet leg apparatus articulated thereon, which each carry fluid jets. A positioning mechansim operates to move each jet leg apparatus bringing the fluid jets of each into close proximity beneath the submerged pipeline in a "V" type position, thus enabling the apparent formation of a trench of desired depth by removal of a minimum volume of material.

The fluid jets of each jet leg apparatus are supplied with high pressure fluid from a floating vessel by fluid jetting conduits. Each jet leg apparatus further includes an air-lift mechansim for removing dislodged waterbed from adjacent the trench being formed. Rollers acting upon load cells sense contact of a jet leg apparatus with the submerged pipeline. Each jet leg apparatus has a center of gravity which is inboard of its pivot point. This arrangement causes the port and the starboard jet leg apparatus to tend to move apart upon the application of an upward force to the jet sled, preventing entanglement with the pipeline.

Each jet leg apparatus is independently, hydraulically movable into position such that the lower end of one jet leg apparatus is in close proximity to the other and directly beneath the submerged pipeline. Varying amounts of proximity may be effected by the adjustment of the connection linkage between the spreader frame and the respective jet leg apparatus. Trench depth adjustment is effected by establishing the relative position of a jetting leg of a jet leg apparatus relative to a respective sled frame member. Relative position is determined and established by a locking bar connceted between the jetting leg and the sled frame member.

Other aspects of this invention not outlined above will be apparent from the detailed description below.

BRIEF DESCRIPTION OF THE DRAWINGS

In order that the manner in which the above-recited advantages and features of the invention can be more readily understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope for the invention may admit to further equally effective embodiments.

In the drawings.

DETAILED DESCRIPTION

General Apparatus

Figure 1:
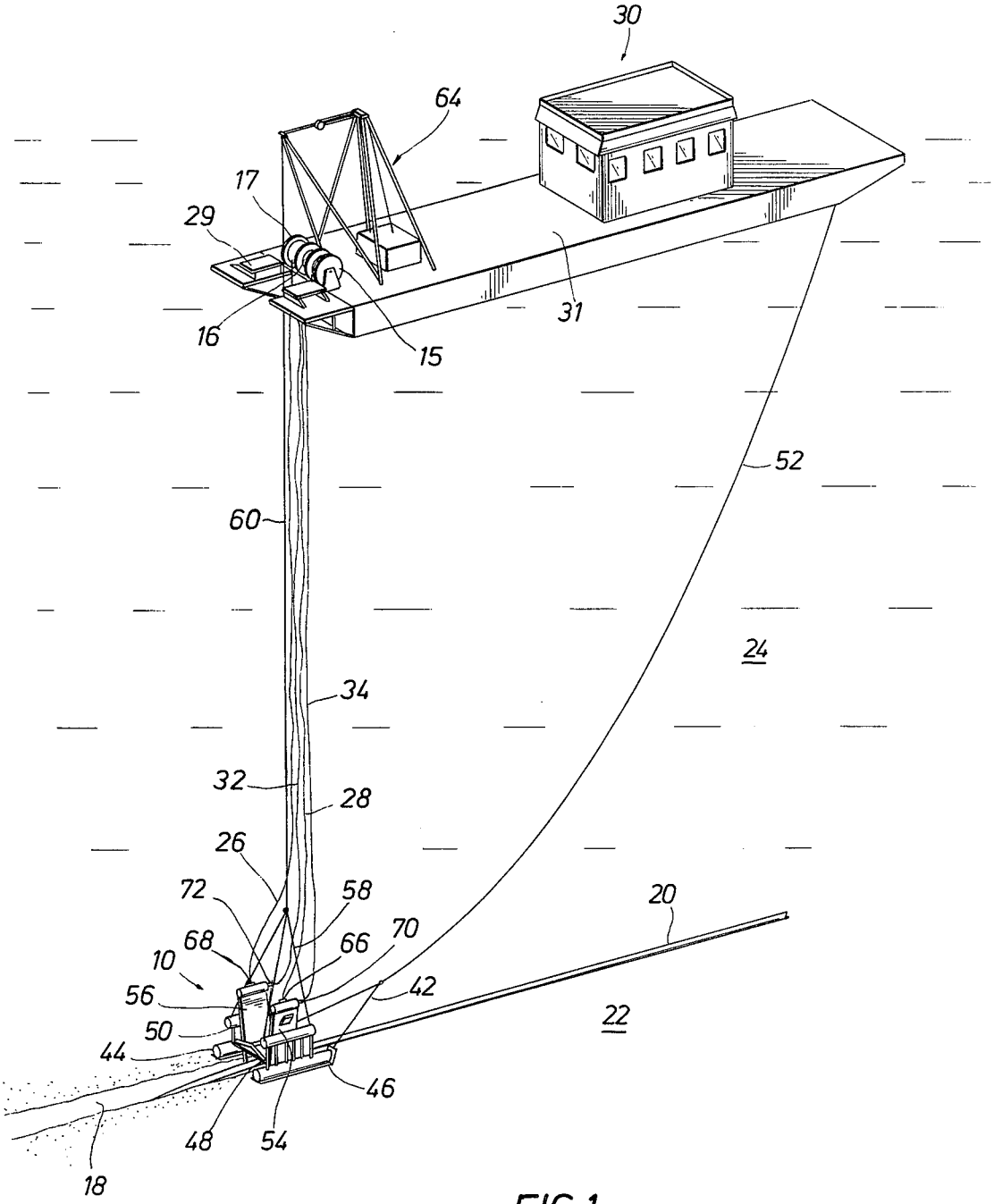
FIG. 1 is a perspective view of an apparatus for entrenching a submerged pipeline including a floating vessel, a jet sled straddling the submerged pipeline and the required conduit connections between the sled and the floating vessel.

Referring now to FIG. 1, there is shown an apparatus for entrenching the pipeline 20 in the bed 22 of a body of water 24. The apparatus includes a floating marine vessel 30, such as a burying barge, and an articulated jet sled 10 in accordance with a preferred embodiment of the present invention.

The articulated jet sled 10 is suspended from the stern of the barge 30 by a support cable 60 and four cable bridle 58. A lifting device 64 is used to raise and lower the jet sled 10 to and from its submerged location proximate the pipeline 20. High pressure air and fluid pumps are located onboard 30 along with other esssential operational and power generation equipment. In the preferred embodiment, the fluid being supplied is water.

Also mounted on barge 30 are three hose reels 15, 16 and 17 which have the air and water lines wound thereon. The high pressure air and fluid pumps on barge 30 connect via a swivel joint to air lines 26 and 28 and high pressure fluid lines 32 and 34 with valves inside the reels providing pressure control. Air lines 26 and 28 connect to air inlets 66 and 68 on jet sled 10. High pressure fluid lines 32 and 34 connect to high pressure fluid inlets 70 and 72 on jet sled 10. The high pressure fluid supplied to jet sled 10 is directed downwardly toward the water bed 22 to form a trench 18 into which pipeline 20 may descend.

The articulated jet sled 10 is towed, sliding above the pipeline 20, by a towing bridle 42 which is connected to the sled pontoon skids 44, 46 and a towing cable 52. Towing cable 52 connects to the bow of the barge 30. As the articulated jet sled 10 is towed along, it forms a trench beneath the pipeline 20 by jetting high pressure fluid into the water bed through starboard and port jetting legs 54 and 56. Dislodged material from the water bed 22 is removed from the trench by an air lift mechanism and expelled through air lift exhaust 36 and 38.

When being transported between working sites, jet sled 10 is raised off water bed 22 by lifting device 64 and placed on sliding cradles 29 on the deck 31 of barge 30. Air lines 26, 28 and high pressure water lines 32 and 34 are wound back onto reels 15, 16 and 17 with sliding cradles 29 permitting jet sled 10 to be placed on barge 30 without the removal of the lines.

Articulated Jet Sled

Figure 3:
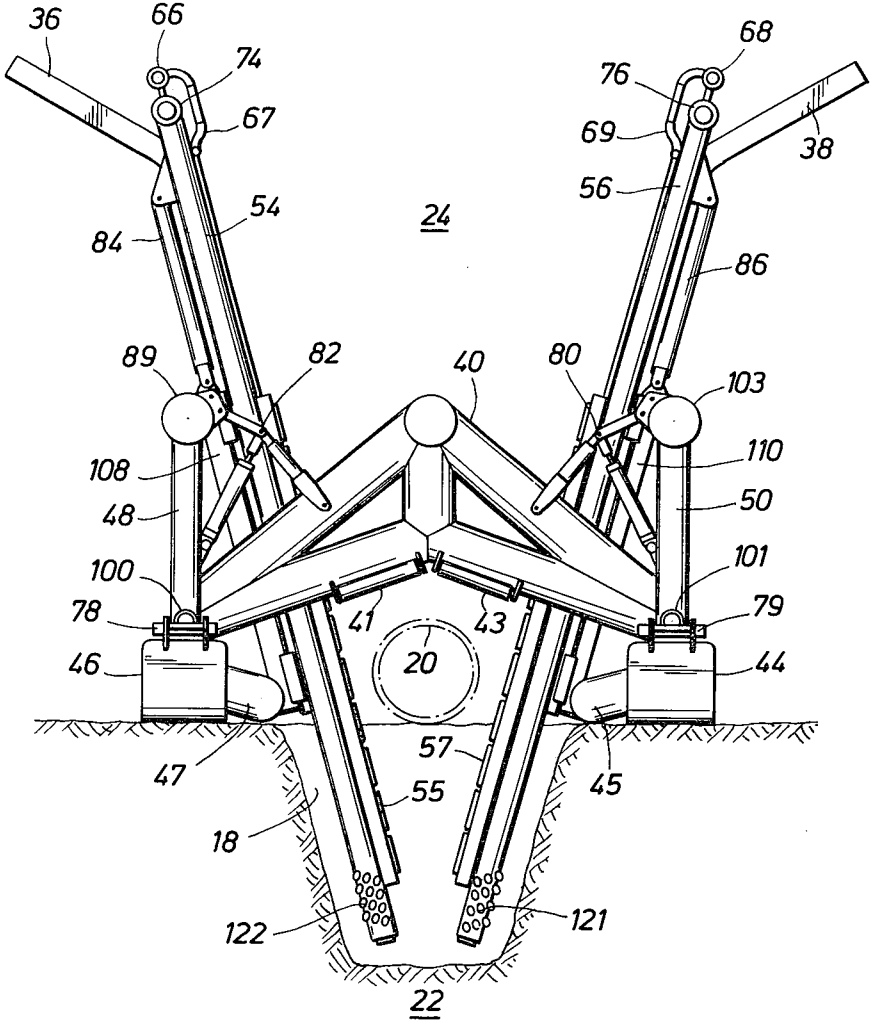
FIG. 3 is a frontal view of the articulated jet sled shown in FIG. 2.
Figure 2:
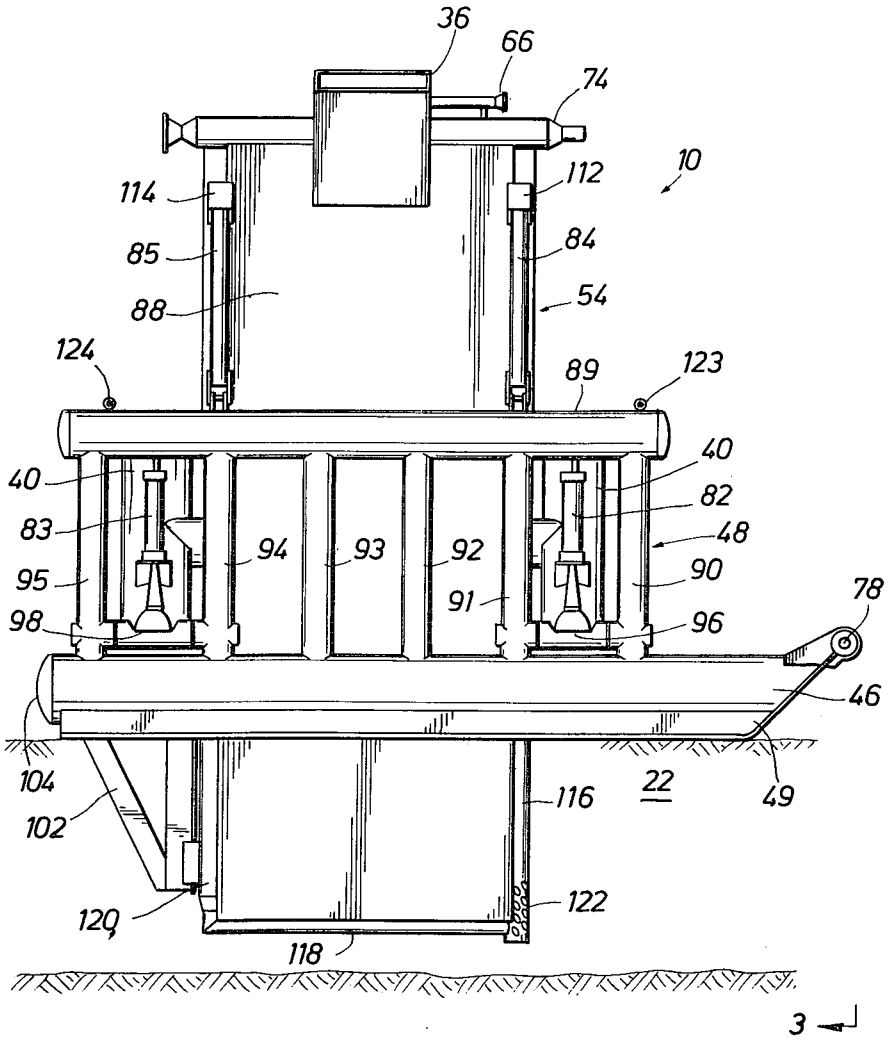
FIG. 2 is a detailed side elevation view of the articulated jet sled showing a jetting leg extending downwardly.
Figure 4:
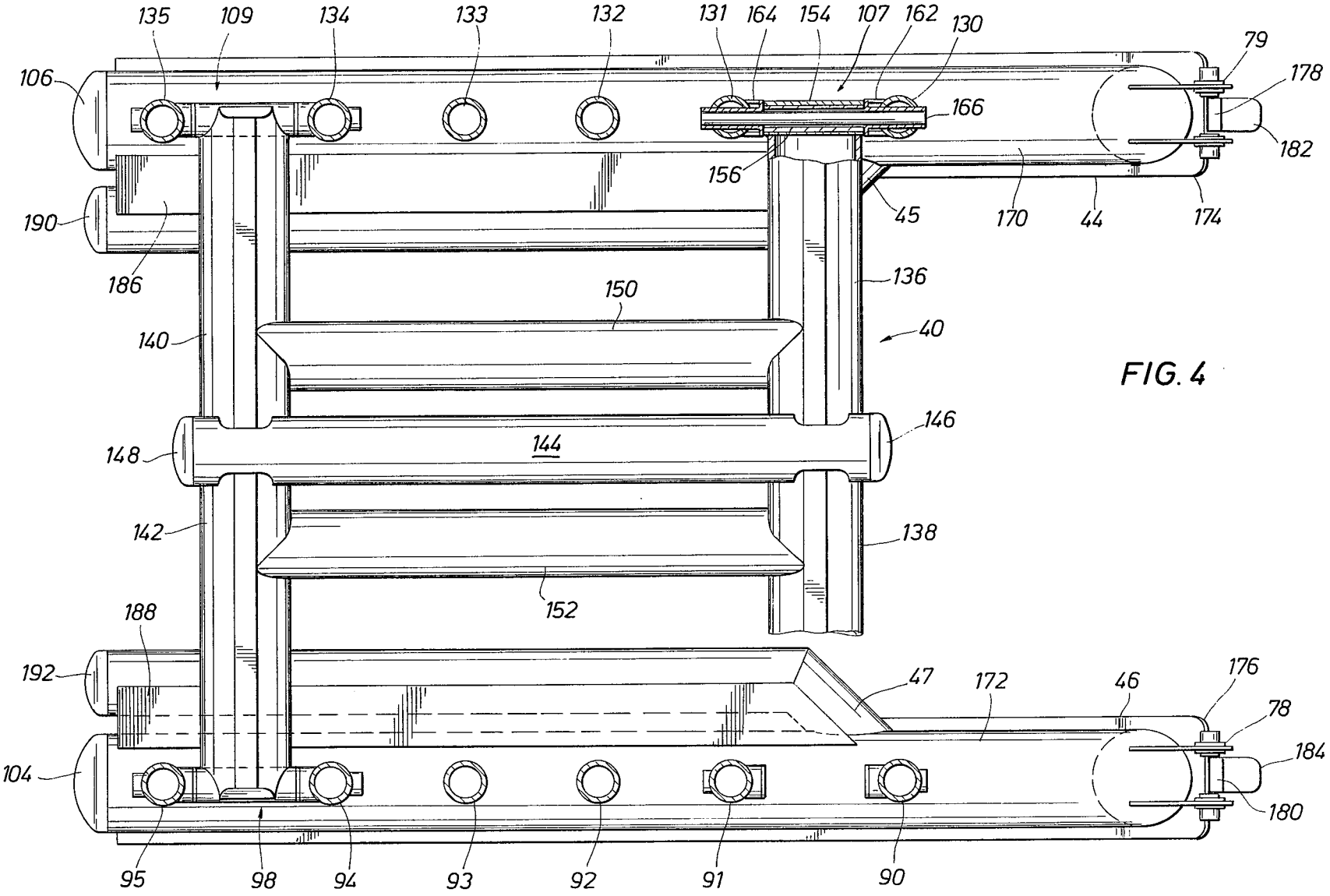
FIG. 4 is a plan view of the spreader frame and port and starboard pontoon skids.

Referring now to FIGS. 2, 3, and 4, there is shown elevation, frontal and plan views, respectively, of a preferred embodiment of the articulated jet sled 10.

Referring specially to FIG. 2, the articulated jet sled 10 is shown resting on a portion of water bed 22 on a starboard pontoon skid 46 and a port pontoon skid 44 (not shown). The pontoon skid 46 is hollow and includes an endcap 104 at its rear portion. The bow end of the starboard pontoon skid 46 carries towing pad eye 78 which provides a point of attachment for towing bridle 42. The pontoon skids 44 and 46 are designed for sliding along the bed on opposite sides of the pipeline 20. To facilitate sliding, a runner 49 is of fixed to the bottom of pontoon skid 46.

Connecting to pontoon skid 46 are vertical supports 90, 91, 92, 93, 94 and 95. Connecting to the upper portion of each of the vertical supports, three is a horizontal brace member 89 which is also a hollow member having end caps. Vertical supports 91–95 and horizontal brace member 89 together form sled frame member 48. An identical structure exists for the port side of the jet sled 10.

A forward extension and a rear extension of spreader frame 40 connect to sled frame member 48 by pivot joints 96 and 98 respectively. Pivot joint 96 is formed between and near the lower portion of vertical supports 90 and 91. Pivot joint 98 is formed between vertical supports 94 and 95. Pivot joints 96 and 98 render starboard sled frame member 48 freely movable about the pivot point formed. To effect movement of sled frame member 48 relative to spreader frame 40, there is provided starboard hydraulic postioning means 82 and 83.

Further shown in FIG. 2 is starboard jetting leg 54 which is connected to sled frame member 48. The lower portion of jetting leg 54 extends beneath pontoon skid 46 and into the water bed below. Also extending beneath pontoon skid 46 is rear support member 102, which is attached to sled frame member 48, serving to add additional support to jetting leg 54. Jetting leg 54 is carried in guide tracks (not shown) attached to sled frame member 48. Giving vertical support to jetting leg 54 and fixing its position in relation to sled frame member 48 are leg locking bars 84 and 85. The lower ends of leg locking bars 84 and 85 connect to horizontal brace member 89. The upper connection of leg locking bars 84 and 85 are made to brackets 112 and 114 attached to jetting leg 54.

Jetting leg 54 has a conduit system about its outer periphery comprised of conduit segments 116, 118, and 120. Conduits 116 and 120 connect to fluid inlet manifold 74 at their upper ends. Fluid Water inlet manifold 74 is a hollow member which receives the high pressure water from high pressure fluid line 32. Proximate the lower portion of conduit 116 are a plurality of jetting apertures 122 for dislodging water bed when high pressure fluid is supplied to conduit 116 from high pressure fluid line 32 via fluid inlte manifold 74.

Attached to and forming a cover for jetting leg 54 is a cover plate 88 which extends from the lower to the upper portions of jetting leg 54. At the upper portion of jetting leg 54, there is an air lift exhaust 36 which extends through the cover plate 88 and serves as the exhaust for the air lift system which removes dislodged water bed from the trench below. Also shown at the upper portion of jetting leg 54 is air intake 66 which supplies air under pressure to the air lift system. Air intake 66 connects to air line 26 extending from barge 30.

Extending upwardly from horizontal brace member 89, are lifting pad eyes 123 and 124. Lifting pad 123 provides an attachment point near the front of jet sled 10 for bridle 58, while lifting pad eye 124 at the rear of jet sled 10 provides an additional connection point for bridle 58. These pad eyes facilitate the connection of the cables of bridle 58 which is used for raising and lowering the jet sled.

Referring now to FIG. 3, there is shown a detailed frontal view of the articulated jet sled 10 with the submerged pipeline 20 shown in phantom. In this view, a trench 18 has been formed beneath pipeline 20 into which the pipeline settles. The articulated jet sled 10 is shown in the trenching position.

Spreader frame 40, an inverted V-shaped structure, stradddles pipeline 20. Spreader frame 40 connects to starboard and port sled frame members 48 and 50 to pivot points 100 and 101. The underside of spreader frame 40 carries spreader frame rollers 41 and 43. Due to the inverted V-shape of spreader frame 40, rollers 41 and 43 are suspended above pipeline 20 and are not in contact with it.

Pontoon skids 44 and 46 connect to their respective sled frame members 48 and 50. Port and starboard pontoon skids 44 and 46 have outriggers 45 and 47, respectively which extend inwardly toward trench 18. Connected between horizontal brace 89, at the top of sled frame member 48, and pontoon outrigger 47 is guide track 108. A similar guide track 110 connects between horizontal brace 103 and outrigger 45.

Jetting leg 54 attaches to sled frame member 48 by engaging guide track 108. Relative position between jetting leg 54 and sled frame member 48 is established by leg locking bar 84. Jetting leg 54 is slidable on guide track 108 with leg locking bar 84 limiting downward travel of jetting leg 54 on guide track 108. Positioning means 82 connects between spreader frame member 40 and sled frame member 48. Positioning means 82 is operable to move sled frame member 48 and jetting leg 54 about pivot point 100 establishing the posture ofjetting leg 54 and consequently the width of trench formed beneath the pipeline. A similar structural arrangement exists for the port side of articulated jet sled 10. A sled frame member and a jetting leg form a jet leg apparatus.

The combined structure of sled frame member 48 and jetting leg 54 has a center of gravity whch is inboard of the pivot point 100. With positioning means 82 released, the structure tends to pivot with the jetting leg 54 tending to assume a substantially upright position. During trenching operations with port and starboard positioning means 80 and 82 released, the application of any force to articulated jet sled 10 tending to urge it from the ocean floor will cause jetting legs 54 and 56 to spread apart preventing any contact with pipeline 20.

In the trenching position as shown, jetting legs 54 and 56 are positioned by positioning means 80 and 82 to place the jetting apertures 121 and 122 in close proximity to each other. Having jetting apertures 121 and 122 in near touching proximity and aligned beneath pipeline 20 minimizes the amount of water bed to be removed in order to form a trench for pipeline 20.

Referring now to FIG. 4, there is shown a plan view of spreader frame 40 mounted to port and starboard pontoon skids 44 and 46. Also, there is shown in detail a mechanism for implementing pivot point 101.

The port and starboard pontoon skids 44 and 46 have generally parallel longitudinal axes and are adapted for sliding along the bed of a body of water upon opposite sides of a pipeline to be entrenched within the water bed. Pontoon skid 44 carries a series of vertical support members 130-135. Starboard pontoon skid 46 carries a similar series of vertical support members 90–95. Both series of vertical support members are depicted as being formed from tubular members, however, other structural designs such as I-beams, T-beams, or L-channels may be utilized.

The pontoon skids 44 and 46 support spreader frame 40 at pivot joints 96 (not shown), 98, 107 and 109. Spreader frame 40 includes front spanning members 136, 138 and rear spanning members 140, 142. Both front and rear spanning members attach to central support brace 144 which is a tubular member having endcaps 146 and 148. Extending parallel to central support brace 144 are port side brace 150 and starboard side brace 152. Port side brace 150 is interconnected between front spanning member 136 and rear spanning member 140. In a similar fashion, starboard side brace 152 is interconnected with front spanning member 138 and rear spanning member 142.

In order to effectuate pivotal movement of sled frame members 48 and 50 relative to spreader frame 40, pivot joints 96 (not shown), 98, 107 and 109 are provided. Only pivot joint 107 is shown in detail, and therefore only it will be discussed. Attached to the end of front spanning member 136 is a collar 154 which carries a bearing surface 156. Collar 154 fits between housings 162 and 164 which are formed in vertical support members 130 and 131 respectively. A shaft 166 slides into housings 162, 164 and collar 154. Shaft 166 defines the pivot point 101, previously referred to in the discussion dealing with FIG. 3, about which the port side sled frame member pivots. Each of the pivot joints are identically constructed and the detailed description in connection with pivot joint 107 is equally applicable to the remaining pivot joints.

Pontoon skid 44 includes pontoon 170, and pontoon skid 46 includes pontoon 172. Attached to the bottom of pontoon 170 is a runner 174 which extends the entire length of pontoon 170. Pontoon 172 has a similar runner 176 attached to it. Pontoon skids 44 and 46 carry identical hinge mechanisms 178 and 180. The hinge mechanisms include towing pad eyes 78, 79 and hinge plates 182, 184. Extending inwardly from the pontoons are the outriggers 45 and 47 which run parallel to their respective pontoons. Outrigger 45 includes an end-cap 190 at its rear portion, and outrigger 47 includes a similar end-cap 192. A support plate 186 is attached between pontoon 170 and outrigger 45. A similar support plate 188 connects between pontoon 172 and outrigger 47.

Figure 5:
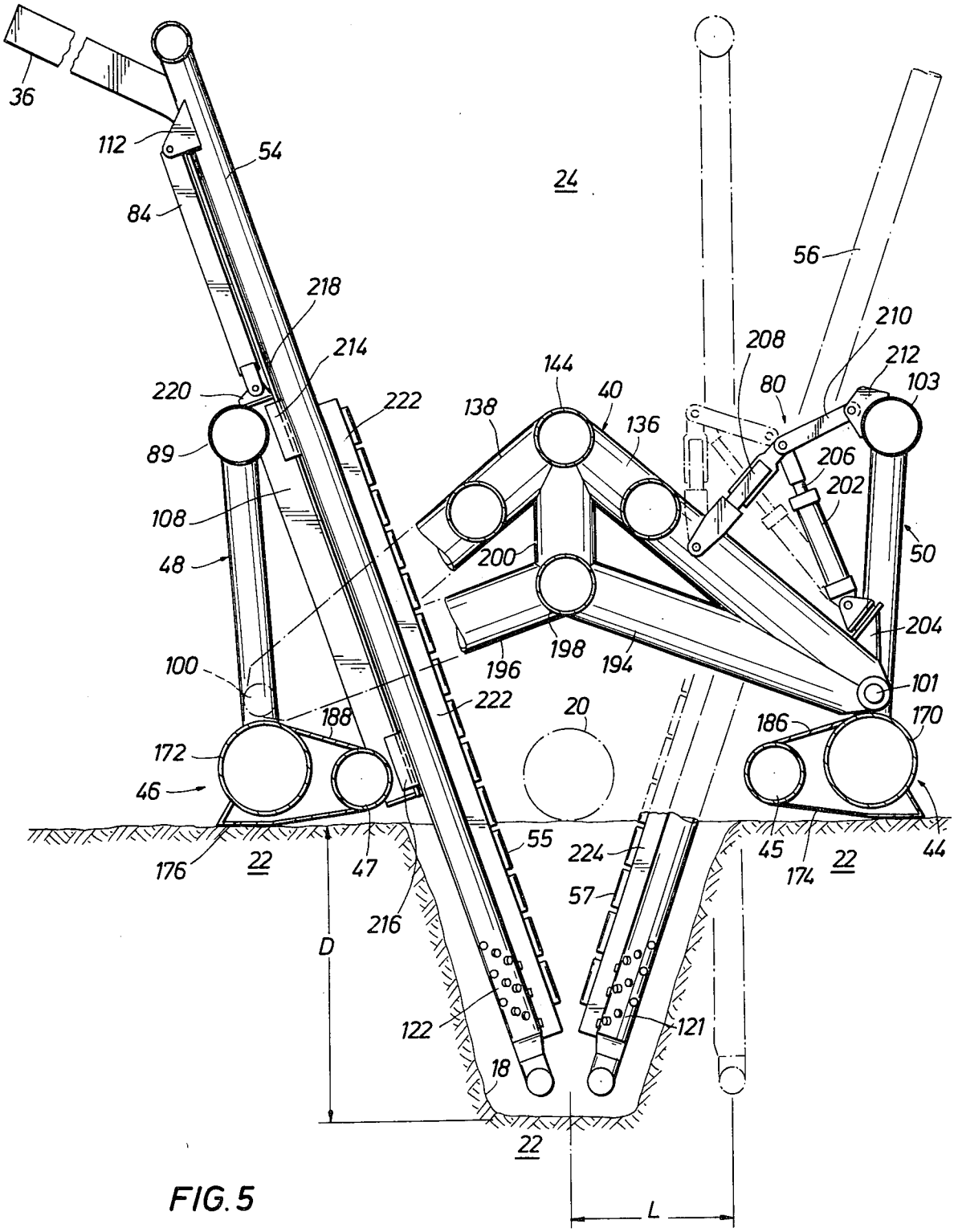
FIG. 5 is a working drawing of a jet leg apparatus and the positioning means for pivoting the jet leg apparatus.

Referring briefly to FIG. 5, there is shown in one aspect a frontal view of spreader frame 40. In this view, the additional structural members of spreader frame 40 are shown. In addition to front spanning member 136 on the port side, there is also a lower spanning member 194 which intersects and connects to spanning member 136. There is a similar spanning member 196 on the starboard side beneath and connected to spanning member 138. A second central brace 198 runs parallel to and beneath central support brace 144. Lower spanning members 194 and 196 connect to second central brace 198 in a manner similar to that in which spanning members 136 and 138 connect to central support brace 144. Disposed between central support brace 144 and second central brace 198 is a vertical standing support member 200.

Spreader frame 40 with its various spanning members and support braces forms a rigid structure for straddling a pipeline that is to be entrenched. Spreader frame 40 due to its inverted V-shape is free from contact with pipeline 20, thereby minimizing the risk of damage to pipeline 20.

Jet Leg Apparatus Movement Mechanism

Figure 6:
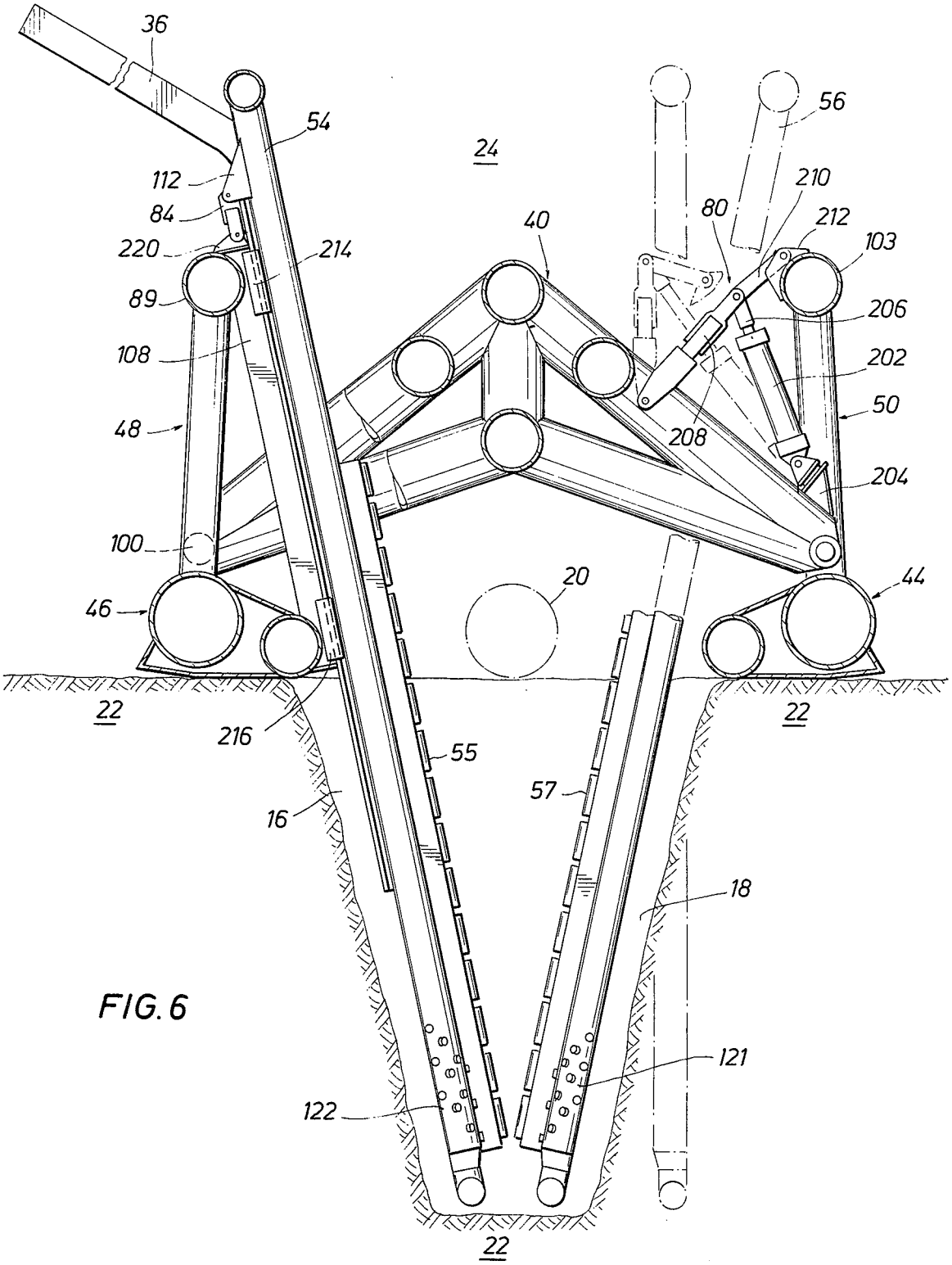
FIG. 6 is a working drawing of the jet leg apparatus and positioning means of FIG. 4, shown in an adjusted position for greater trench depth.

Referring now to FIGS. 5 and 6, there is shown a sectioned frontal view of articulated jet sled 10. In each view, there is a detailed illustration of positioning means 80 which is the movement mechanism for the port side jet leg apparatus of articulated jet sled 10.

Positioning means 80 is a hydraulic system for effecting movement of sled frame member 50 about pivot point 101. Pivotal movement of sled frame member 50 causes jetting leg 56 shown in phantom to move from a substantially vertical position to an inclined position. In the inclined position, jetting apertures 121 carried by jetting leg 56 are positioned centrally of jet sled 10 and beneath pipeline 20.

Pontoon skid 44 is shown connected to the lower end of sled frame member 50 just below pivot point 101. Pontoon runner 174 is shown attached to pontoon 170 and outrigger 45. Pontoon runner 174 gives the underside of pontoon skid 44 a generally arc-shaped configuration. This configuration facilitates movement of sled frame member 50 relative to spreader frame 40 by permitting a rocking type motion.

Positioning means 80 includes a hydraulic cylinder 202 which is securely attached to spanning member 136 of spreader frame member 40 by bracket 204. Actuator rod 206 of hydraulic cylinder 202 is extensible or retractable as desired. Actuator rod 206 is pinned to connecting arm 208 and variable link 210. Connecting arm 208 connects to spanning member 136 of spreader frame 40 where it is pinned for pivotal movement relative to spreader frame 40. Variable link 210 is pinned to plate 212 which is welded to horizontal brace 103 of sled frame member 50.

Hydraulic extension of actuator rod 206 from hydraulic cylinder 202 urges connecting arm 208 and variable link 210 outwardly. Force is applied via variable link 210 to sled frame member 50 causing it to pivot counterclockwise about pivot point 101. Pivotal movement in this manner of sled frame member 50 causes jetting leg 56 to move into a substantially vertical position. Retraction of actuator rod 206 into hydraulic cylinder 202 pulls connecting arm 208 and variable link 210 downwardly and urges them into a substantially aligned relation. It should be noted, however, that the linkage is designed such that it does not travel beyond an aligned attitude, thereby preventing the linkage from locking and becomng inoperative. This movement forces sled frame member 50 to pivot clockwise about pivot point 101 placing jetting leg 56 in an inclined posture.

To effect varying degrees of inclination for a given amount of extension of actuator rod 206, variable link 210 can be lengthened or shortened. Lengthening or shortening of variable link 210 for a given actuator rod 206 extension length, will cause sled frame member 50 to be moved further counterclockwise or further clockwise effecting a more inclined or less inclined jetting leg 56 posture.

A similar arrangement exists for positioning means 82 on the starboard side of articulated jet sled 10. Positioning means 80 and 82 may be operated independently or simultaneously. The degree of pivotal movement of sled frame member 50 and the angle of inclination of jetting leg 56 will depend upon the size of pipeline 20 and the depth to which it is to be laid.

For the arrangement shown in FIG. 5 in which the trench depth is approximately seven feet, a preferred length for variable link 210 is approximately 2′ 1¾ inches. The lateral displacement (L) from vertical positioning of jetting leg 56 in this embodiment is preferably 3½ feet. For the embodiment shown in FIG. 6, wherein the trench depth is approximately fifteen feet, varible link 210 is preferably 1 foot 7⅞ inches. The lateral displacement off vertical alignment in the preferred embodiment of FIG. 6 is approximately 5 feet 3½ inches. Between the ranges given with respect to the embodiments of FIG. 5 and FIG. 6, there are several alternate angles of inclination and amounts of lateral displacement which jetting leg 56 may assume. In general, as the trench 18 depth becomes greater, the length of variable link 210 will become shorter decreasing the amount of pivotal movement of sled frame member 50.

Jetting Leg Adjustment Mechanism

Further referring to FIGS. 5 and 6, there is shown in detail, on the starboard side of jet sled 10, the mounting device and adjustment mechanism for jetting leg 54. Jetting leg 54 mounts to a plurality of guide tracks of which only guide track 108 is in view. Guide track 108, as are the other guide tracks, is a structural member which is attached to sled frame member 48. Specifically, guide track 108 is welded at one end to horizontal brace 89 and at the opposite end to outrigger 47. Guide track 108 carries an upper guide shoe 214 and a lower guide shoe 216. Guide shoes 214 and 216 are U-shaped elements having lips turned inwardly. Guide shoes 214 and 216 receive a T-shaped guide rail 218 that is carried on jetting leg 54. Further details of the guide rails used will be given in conjunction with the detailed description of FIG. 7 concerning jetting leg 56.

The upper end of guide track 108 has an extension plate 220 in which the lower end of leg locking bar 84 is pinned. The upper end of leg locking bar 84 is held in bracket 112 which is affixed to jetting leg 54.

Jetting leg 54 is mounted to sled frame member 58 by placing the T-shaped guide rails of jetting leg 54 into the guide shoes of the various guide tracks. Guide rail 218 is slidable in upper and lower guide shoes 214 and 216. Relative position between jetting leg 54 and sled frame member 48 is established by leg locking bar 84 which limits the downward travel of jetting leg 54. Various depths of trench 18 can be obtained by varying the length of leg locking bar 84. For example, in the embodiment shown in FIG. 5, leg locking bar 84 limits the depth (D) of trench 18 to approximately seven feet. In the embodiment shown in FIG. 6, leg locking bar 84 is very much smaller than that shown in FIG. 5 permitting jetting leg 54 to slide further down on guide track 108 to produce a trench 18 depth of approximately fifteen feet. It is therefore possible to establish varying degrees of trench 18 depth by varying the length of leg locking bar 84.

It will be appreciated that as the length of leg locking bar 84 becomes shorter and jetting leg 54 slides further down on guide track 108 that the variable link of positioning means 82 will become shorter in order to limit the amount of pivotal movement of sled frame member 48. This limitation of pivotal movement is necessary so that the ends of jetting legs 54 and 56 can be extended to the depth desired without coming into contact with one another.

Jetting Leg

Figure 7:
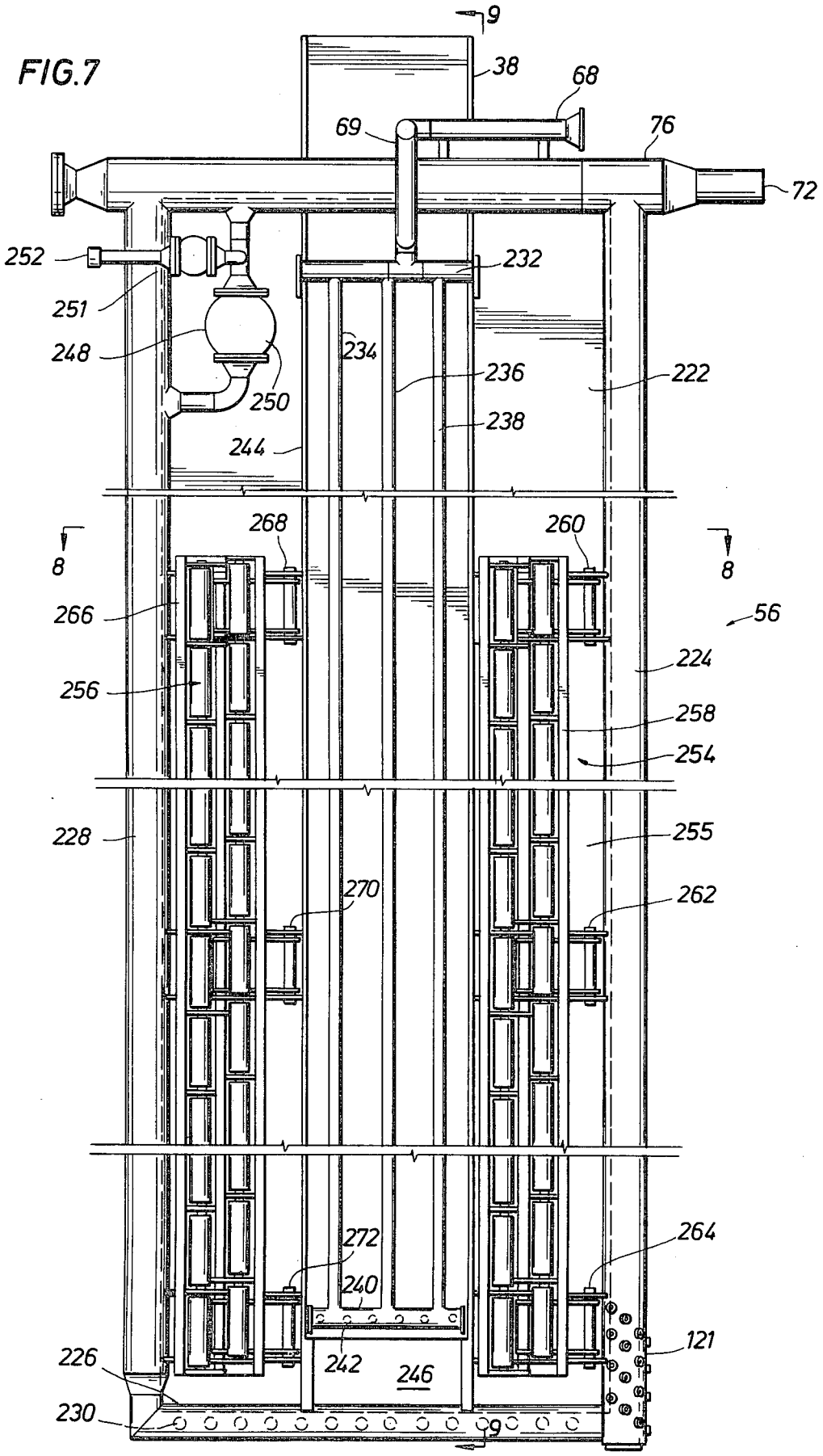
FIG. 7 is a detailed elevation view of a jetting leg.
Figure 9:
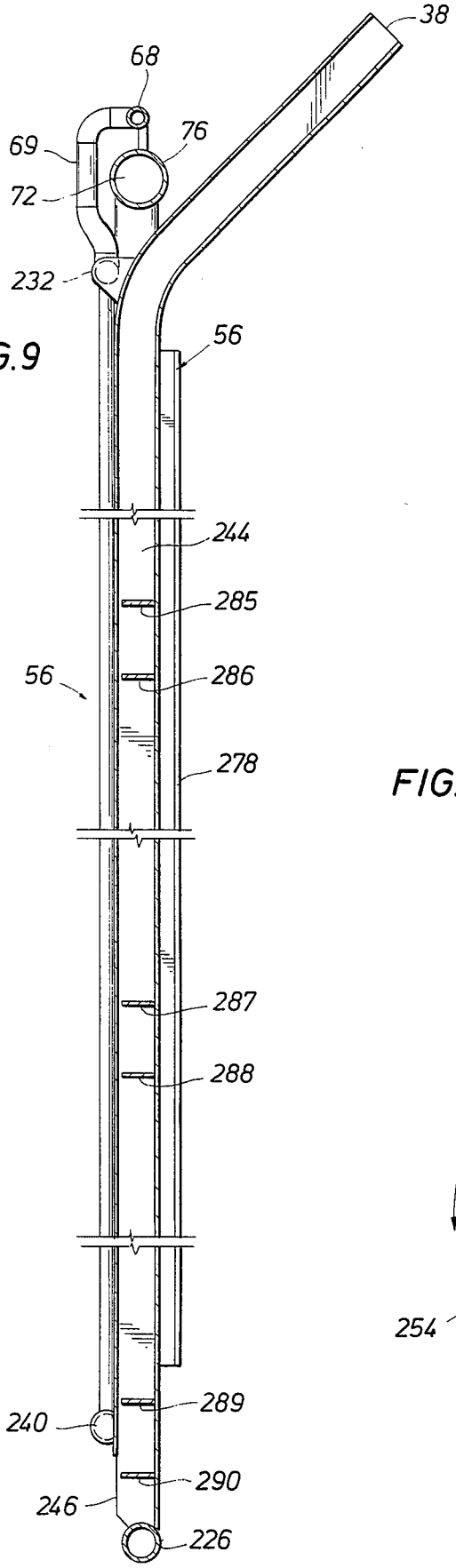
FIG. 9 is a cross-sectional front view of the jetting leg of FIG. 7.
Figure 8:
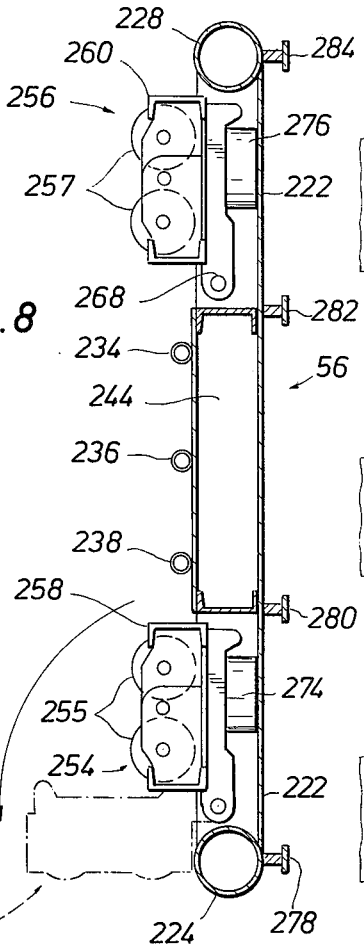
FIG. 8 is a cross-sectional plan view of the jetting leg of FIG. 7.
Figure 11B:
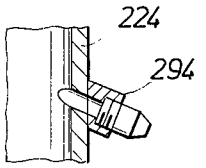
Figure 11C:
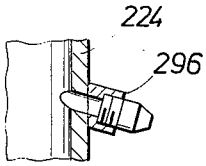
Figure 11D:
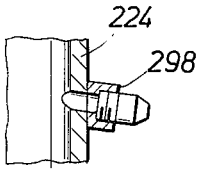
Figure 11E:
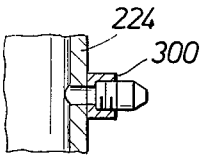

Referring now to FIGS. 7, 8, and 9, there is shown elevation, frontal and plan views, respectively, of a preferred embodiment for the jetting leg 56 of the articulated jet sled 10.

Referring specifically to FIG. 7, there is shown the inside of jetting leg 56. Jetting leg 56 is a rectangular structure having an outside cover plate 222 and a frame work formed by conduit segments 224, 226, and 228. Water inlet manifold 76 in combination with conduit segments 224, 226 and 228 form the outer periphery of jetting leg 56. Outside cover plate 222 is welded to the aforementioned structural elements at its edges. Conduit segment 224 carries a plurality of jetting apertures 121 which provide primary jetting action. Additional apertures 230 shown in phantom in conduit segment 226 are optional providing additional jetting action laterally along the pipeline to be laid. Water inlet manifold 76 receives high pressure water via inlet 72 from the source of high pressure water aboard the floating vessel. The high pressure water introduced into the conduit system then fills conduit segments 224, 226.

Just above water inlet manifold 76 is air intake 68 which has attached to it air conduit 69. Air conduit 69 turns down and supplies air to upper air plennum chamber 232. Air plennum chamber 232 has tapped into it three conduits 234, 236 and 238. These conduits extend along the interior of jetting leg 56 and have parallel axes that are generally parallel to conduit segments 224 and 226. The conduits 234, 236 and 238 terminate in a lower air plennum chamber 240. This chamber has a series of apertures 242 which releases the air just above the lower edge of jetting leg 56. The air supply system just described forms one part of the air lift system for removing detritus material from within the trench being formed by the jetting apertures 121.

Another portion of the air left system is air lift tunnel 244 which extends the entire length of jetting leg 56 and is disposed in a substantially central location as shown in the drawing. Near the bottom of jetting leg 56 and adjacent the lower air plennum chamber 240 is an air lift opening 246. Dislodged material from the water bed enters air lift tunnel 244 through air lift opening 246. The symmetrical flow of air inwardly near the air lift opening 246 will serve to uniformly mix the air and detritus material within the lower confines of air lift tunnel 244. This mixing is effective to reduce the specific gravity of the detritus solution within the tunnel, thus lifting the material up through the air lift tunnel 244 by the well-known air lift technique. The material rises and is finally exhausted at a location above water inlet manifold 76 from air lift exhaust 38.

There is shown connected between water inlet manifold 76 and conduit segment 228 an alternate fluid jetting source 248 which includes a ball valve 250 and tap off 251 for supplying pressurized fluid to auxiliary fluid outlet 252. Auxiliary fluid output 252 provides a source of pressurized fluid to which a hose may be connected by a diver and used for manual jetting of the water bed.

There is also shown in FIG. 7, fore and aft roller assemblies 254 and 256 for maintaining the jet sled in a properly aligned posture with respect to the central axis of a pipeline to be entrenched.

Roller assembly 254 includes a roller carriage 258. Roller carriage 258 carries rollers 255 in two vertical, parallel columns and provides separate rotational movement for each roller. Roller carriage 258 is mounted in jetting leg 56 by hinges 260, 262 and 264. Due to its hinged connected to jetting leg 56, roller carriage 258 is able to swing out from the inside surface of jetting leg 56. The swinging motion provided by the hinged connection permits roller carriage 258 to actuate load cells associated therewith to signal at a remote location contact of the pipeline with the rollers.

The stern roller assembly 256 has a roller carriage 266 and is identical in structure and function with the forward roller assembly 254. The roller assemblies 254 and 256 serve in cooperation to maintain the sled in proper trenching alignment. Roller assembly 256 is also free to swing in a manner similar to that of roller carriage 258 for actuating load cells.

Referring now to FIG. 8, there is shown a plan view of jetting leg 56. In this view, the load sensing cells 274 and 276 previously alluded to are shown. Load sensing cell 274 is disposed between hinge connection 260 and cover plate 222. Load sensing cell 276 is disposed between hinge connection 268 and cover plate 222. Since roller assemblies 254 and 256 are free to swing about hinge connections 260 and 268, contact of the roller assemblies with a pipeline to be entrenched would cause the roller assemblies to be urged against their respective load sensing cells. Thus, an operator on board the floating vessel can monitor displacement of the sled with respect to the pipeline and any cross-pull that is being applied to the sled. From the signals produced by the load sensing cells 274 and 276, it is possible to maintain a parallel relationship between the longitudinal axes of the pontoon skids and the elongate structure to be entrenched during the trenching operation.

Also shown in FIG. 8 is the arrangement of air lift tunnel 244 and conduits 234, 236 and 238. Air lift tunnel 244 is observed to be a rectangular opening disposed centrally of jetting leg 56.

Attached to cover plate 222 are T-shaped guide rails 278, 280, 282, and 284. These guide rails are positioned symmetrically across jetting leg 56. The T-shaped guide rails will engage the guide shoes which are mounted on the port side guide track and mount jetting leg 56 to the port side sled frame member.

Referring now to FIG. 9, there is shown a section frontal view of jetting leg 56. In this view, air lift tunnel 244 is observed to extend substantially the entire length of jetting leg 56. Air lift tunnel 244 turns outward near its upper end and terminates in air lift exhaust 38. T-shaped guide rail 278 extends from just beneath the curved portion of air lift tunnel 244 downwardly and ends near the bottom of jetting leg 56. Also shown are hinge flanges 285-290.

Jetting Apertures

Referring now to FIG. 10 and FIGS. 11A–11E, there is shown the jetting aperture orientation for a single row of jetting apertures on conduit segment 224 of port side jetting leg 56. Jetting apertures 121 comprise a series of rows such as that shown in FIG. 10.

Figure 10:
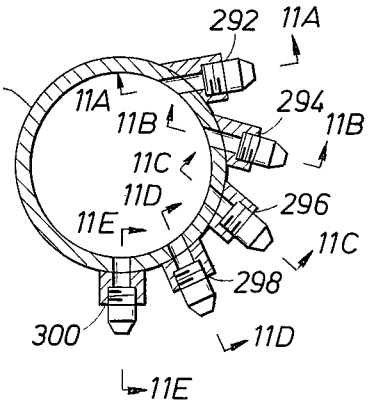
FIG. 10 is a cross-sectional plan view of one row of jetting apertures of the jetting leg shown in FIG. 7.
Figure 11A:
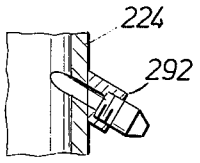
FIGS. 11A–11E are side views of the jetting apertures of FIG. 10.

Specifically, FIG. 10 is a cross-sectional plan view of conduit segment 224 which has fluid jet apertures 292, 294, 296, 298 and 300. The fluid jet apertures extend outwardly from conduit segment 224 and are arranged around the frontal portion thereof. Each of the fluid jet apertures is aimed along a slightly different angle from any of the others. In the preferred embodiment shown, the angle may vary from 0° for aperture 300, to 100°, as or aperture 292. Each fluid jet aperture has a passsage which extends through the wall of conduit segment 224 to form an outlet port for the high pressure fluid contained therein. As previously mentioned, high pressure fluid may be jetted through apertures 292–300 to erode away the water bed. In some instances, the eroding action may be accentuated by adding high velocity nozzles within the apertures. The particular selection of nozzles and the specific pattern of application may vary depending upon the type of soil encountered to most efficiently and rapidly cut away the submerged formation.

FIGS. 11A–11E show a separate cross-sectional view of each fluid jet aperture 292, 294, 296, 298 and 300. From the views presented, it is observed that the jetting apertures are positioned with varying degrees of downward inclination. The range of angles for the preferred embodiment shown is from 30° for fluid jet aperture 292 to 0° for fluid jet aperture 300. Therefore, it is apparent that all fluid jet apertures except aperture 300 direct their fluid jet downwardly into the water bed formation with aperture 300 directing its fluid jet transversely to the trench being formed.

The cross-sectional area of all fluid jet apertures is substantially identical producing an equal volume of fluid delivered for jetting action. It will be realized that the jetting nozzles are generally directed downwardly into the water bed which is directly in front of the jetting legs.

Operation

In operation when it is desired to entrench a submerged pipeline, the exterior size of the pipeline is determined, and the port and starboard jetting legs are adjusted to position them for producing the proper trench depth to accomodate the pipeline. Further, the positioning means are adjusted to provide the angle of inclination for each jet leg apparatus that is necessary for proper trench width.

Vertical adjustment is achieved by disconnecting each jetting leg and sliding it along its guide track until the desired postion is reached. Leg locking bars are then installed to maintain each jetting leg at the proper position. Pivotal adjustment is performed by installing the proper variable link into each positioning means.

The jet sled is then lowered over the stern of the barge by a hoist. The articulated jet sled is lowered until the ends of the jetting legs are near the water bed and on each side of the pipeline to be entrenched. High pressure fluid is then supplied to each jetting leg and the air lift mechanism is actuated. High pressure jets of fluid cut away the water bed below with the spoil produced by the cutting action being withdrawn from around the pipeline. As the water bed is removed, the jet sled is continued to be lowered until the pontoon skids are resting on the water bed on each side of the pipeline.

With the jet sled resting on the ocean floor and straddling the pipeline, the jet leg apparatus are pivoted by the positioning means placing their ends directly beneath the pipeline. Jetting continues as the barge pulls the sled forwardly forming a trench within the water bed as it goes.

As jetting action continues, the air lift mechanism of each jetting leg removes dislodged water bed from the trench being formed and exhausts the material to the side of the trench. Upon encountering water bed formations of hard material, it is necessary to increase the cutting action of the fluid jet. This may be accomplished by increasing the pressure of the fluid being supplied to each jetting leg. The streams of intensified pressurized fluid will remove the hard water bed permitting the trench to be continued. In the event that the increased jetting action does not sufficiently dislodge the formations, a diver may descend and utilize the auxiliary fluid jet to break the formation into a convenient size for removal. In order to minimize the requirement for hand jetting techniques in this situation, the fluid jet nozzles at the end of each jetting leg are placed in very close proximity by the design of the jetting sled, such design being made feasible through the pivotal movement with which the jetting legs are provided.

If rough seas are encountered, an emergency situation arises, or for any reason the sled must be raised, the articulated jet sled is easily removed from its submerged location. When pressure on the hydraulic cylinders holding the jetting legs beneath the pipeline is released, the port and starboard jet leg apparatus pivot about their respective pivot points because of the enfluence of gravity acting upon the center of gravity of each. With the jet leg apparatus free to swing outwardly from the pipeline, the hoist on the barge can raise the jet sled to the surface.

SUMMARY OF THE MAJOR ADVANTAGES

It will be appreciated by those skilled in the art that the above described articulated jet sled for entrenching elongate structures provides a considerable advantage over other burying sled devices in its performance of entrenching submerged elongate structures.

A specific advantage of the present invention is the arrangement of the port and starboard jet leg apparatus which are pivoted for movement relative to the frame and have a center of gravity inboard of the pivot points. Such an arrangement enables the jetting apertures on the jetting legs to be positioned beneath a pipeline, minimizing the amount of soil to be removed, yet permits the jet sled to be urged off the waterbed without entanglement with and damage to the pipeline.

Another particular advantage of the present invention is the great degree of adjustability provided which permits the accommodation of a wide variety of elongate structure sizes and the formation of a variety of trench depths.

It is a further significant advantage of the present invention to provide an entrenching apparatus which does not ride along the pipeline in order to obtain direction guidance. Instead, the present invention relies upon load sensing cells associated with rollers to sense sled direction.

The foregoing description of the invention has been directed to a particular preferred embodiment in accordance with the requirements of the Patent Statutes and for purposes of explanation and illustration. It will be apparent, however, to those skilled in this art that many modifications and changes in the apparatus may be made without departing from the scope and spirit of the invention. For example, the jet leg apparatus may be pivoted directly to the spreader frame with the sled frame members rigidly fixed to the spreader frame or eliminated entirely. Also, adjustability of the jetting legs relative to the frame may be accomplished by using releasable clamps, rather than guide tracks. Further, a jacking device may be utilized in place of the leg locking bar to fix the vertical position of the jet leg. A yet further modification of the apparatus would be to provide a fluid motor connected between the frame and a jet leg apparatus for pivoting the jet leg apparatus. These and other modifications of the invention will be apparent to those skilled in this art. It is the applicants' intention in the following claims to cover all such equivalent modifications and variations as fall within the true spirit and scope of the invention.

What is claimed is:

1. Apparatus for entrenching a submerged elongated structure such as a pipeline or cable in the subsoil beneath a body of water, comprising:

a frame for disposition above the elongate structure; first and second jet leg apparatus extending downwardly on opposite sides of said elongate structure;

said first and second jet leg apparatus each being mounted on the frame for pivotal movement about an axis parallel to the elongate structure, with the center of gravity of each apparatus being inboard of the pivot axis; and positioning means for pivoting said first and second jet leg apparatus about said pivot axes to move said jet leg apparatus from a substantially vertical attitude to an attitude wherein the lower end of each jet leg is below and beneath the elongate structure to form a trench within the subsoil to accommodate the elongate structure;

said positioning means serving to apply a restraining force to said jet legs to maintain the lower ends thereof below and beneath the elongate structure, with the lower ends of said jet legs being free to swing outwardly upon the release of the restraining force.

2. The apparatus of claim 1 wherein said first and second jet apparatus are adjustable for various trench depths by establishing the vertical position of said first and second jet leg apparatus relative to said frame.

3. The apparatus of claim 2, further comprising adjustment means for establishing the vertical placement of each of said fluid jet means relative to said frame means to set the depth of the trench to be formed beneath the elongate structure.

4. The apparatus of claim 1, wherein each of said jet leg apparatus includes roller means for sensing contact with the elongate member.

5. The apparatus of claim 4, wherein said roller means includes a load sensing cell.

6. The apparatus of claim 1, wherein said positioning means includes a hydraulic cylinder connected between said frame and each of said first and second jet leg apparatus and operable to allow the portions of said first and second jet leg apparatus beneath and below the elongate structure to swing outwardly upon the release of pressure on said cylinder.

7. The apparatus of claim 6, wherein said positioning means includes a linkage between each of said first and second jet leg apparatus and said frame, said linkage being operated by said hydraulic cylinder and having an adjustable link to effect various positions of angular attitude of said first and second jet let apparatus when said linkage is operated by said hydraulic cylinder.

8. The apparatus of claim 7, wherein said linkage is movable from a first position in which the said first and second jet leg apparatus are maintained below and beneath said elongate structure to a second position in which said first and second jet leg apparatus are not beneath the elongate structure to enable the entrenching apparatus to be removed from said elongate structure, and wherein said linkage will assume the second position upon release of hydraulic pressure on said cylinder.

9. The apparatus of claim 1, further comprising air lift means for removing detritus material from the trench below said elongate structure.

10. The apparatus of claim 1, further comprising:

a first pontoon skid affixed to the port side of said frame means; and a second pontoon skid affixed to the starboard side of said frame means.

11. The apparatus of claim 1, wherein each of said first and second jet leg apparatus comprises:

a sled frame member pivoted in said frame; and a jetting leg attached to said sled frame member and having at least one fluid jet nozzle.

12. The apparatus of claim 11, wherein said jetting leg has a guide rail and said sled frame member has a guide channel for receiving the guide rail for slidable movement thereon, and including means to hold said jetting leg at a plurality of positions relative to said sled frame member to adjust the position of said jetting legs relative to said elongate structure.

13. The apparatus of claim 11, including rigid members adapted to be connected between said jetting leg and said sled frame member to adjust the position of said jetting legs.

14. The apparatus of claim 13, further comprising a pontoon skid attached to each of said sled frame members for facilitating sliding on the floor of a body of water.

15. Apparatus for entrenching a submerged elongate structure such as a pipeline or cable in the subsoil beneath a body of water, comprising:

a frame for disposition above the elongate structure; first and second guide tracks fixed relative to said frame on opposing sides of the elongate structure;

first and second jetting legs extending below the elongate structure on opposite sides thereof for forming a trench within the subsoil to accommodate the elongate structure;

said first and second jetting legs being pivotally mounted on the frame, and said jetting legs having means operably engaging guide tracks to render said jetting legs vertically movable with respect to the elongate structure; and adjustment means for fixing the position of said jetting legs on said guide tracks to position the jetting legs to form a trench of selected depth in the subsoil beneath said elongate structure.

16. The apparatus of claim 15, further including:

first and second pontoon skids attached to said frame and having generally mutually parallel longitudinal axes, said pontoon skids being spaced to straddle the elongate structure to be entrenched.

17. The apparatus of claim 15, wherein said means operably engaging said guide tracks comprises a T-shaped fitting, and each of said guide tracks comprises a T-slot.

18. The apparatus of claim 17, wherein said adjustment means comprises a rigid member of a prescribed length.

19. The apparatus of claim 15, further including positioning means for pivoting said first and second jetting legs about said pivot points to position the jetting legs below and beneath the elongate structure.

20. Apparatus for entrenching a submerged elongate structure such as a pipeline or cable in the subsoil beneath a body of water, comprising:

a frame for straddling disposition above the elongate structure;

first and second jet leg apparatus extending below and beneath the elongate structure on opposite sides thereof, said first and second jet leg apparatus each being pivotally mounted on the frame with the center of gravity of each apparatus being inboard of the pivot point, and wherein each of said jet leg apparatus includes a jetting leg having fluid jet apertures;

positioning means for pivoting said first and second jet leg apparatus about the pivot points to place the fluid jet apertures on the jetting legs below and beneath the elongate structure;

said positioning means comprising in combination a linkage between each of said first and second jet leg apparatus and said frame, and a hydraulic cylinder connected between said frame and said linkage;

a first and second guide tracks fixed relative to said frame on opposing sides of the elongate structure;

first and second guide members on each of said jetting legs operably engaging said guide tracks to render said jetting legs vertically movable with respect to the elongate structure; and adjustment means for fixing the position of said guide members on said guide tracks to position the jetting legs to form a trench of selected depth in the subsoil beneath the elongate structure 21. The apparatus of claim 20, wherein said linkage is operated by said hydraulic cylinder to move said first and second jet leg apparatus from a first position in which said jet leg apparatus are not beneath the elongate structure to a second position in which a portion of each jet leg apparatus is maintained beneath the elongate structure.

22. The apparatus of claim 21, wherein said linkage allows the portions of each jet leg apparatus beneath the elongate structure to swing outwardly upon the release of pressure on said cylinder to assume the first position.

23. The apparatus of claim 22, wherein said adjustment means comprises interchangeable structural members in different length.

24. The apparatus of claim 23, wherein each of said guide members comprises a T-shaped fitting, and each of said guide track comprises a T-slot.

* * * * *